US005107902A

United States Patent [19]

Wahhoud

[11] Patent Number: 5,107,902

[45] Date of Patent: Apr. 28, 1992

[54] METHOD FOR CONTROLLING WEFT THREAD INSERTION TIMING IN AN AIR JET LOOM

[75] Inventor: Adnan Wahhoud, Bodolz, Fed. Rep. of Germany

[73] Assignee: Lindauer Dornier Gesellschaft GmbH, Lindau, Fed. Rep. of Germany

[21] Appl. No.: 687,998

[22] Filed: Apr. 19, 1991

[30] Foreign Application Priority Data

Apr. 20, 1990 [DE] Fed. Rep. of Germany ..... 4012616

[51] Int. Cl.[5] ..... D03D 47/30

[52] U.S. Cl. ..... 139/435.1; 139/435.2

[58] Field of Search ..... 139/435.1, 435.2, 435.5

[56] References Cited

U.S. PATENT DOCUMENTS 4,446,893 5/1984 Gunneman et al. ..... 139/435.1 X
4,967,806 11/1990 Imamura et al. ..... 139/435.1
5,031,669 7/1991 Wahhoud et al. ..... 139/435.1 X

FOREIGN PATENT DOCUMENTS 0105561 2/1987 European Pat. Off. .
3002862 7/1981 Fed. Rep. of Germany .

*Primary Examiner*—Andrew M. Falik
*Attorney, Agent, or Firm*—W. G. Fasse

[57] ABSTRACT

The insertion of a weft thread into the loom shed through the weft thread insertion channel of an air jet loom is controlled in two phases in order to apply the proper weft thread acceleration to each type of yarn individually so that too slow insertions and too fast insertions can be corrected. Following a first acceleration, the starting point for the second acceleration is either advanced or delayed. When the weft thread arrives too late, the application of the second acceleration at a higher pressure than the first acceleration, is shifted forward to take place earlier. If the weft thread arrives too early, the application of the second acceleration is delayed to again compensate for achieving a proper arrival time of the weft thread at the exit end of the insertion channel. If the rated insertion time duration coincides with the actually measured insertion time duration, a correction is not needed.

11 Claims, 2 Drawing Sheets

METHOD FOR CONTROLLING WEFT THREAD INSERTION TIMING IN AN AIR JET LOOM

CROSS-REFERENCE TO RELATED APPLICATION

This application is related to U.S. Ser. No. 07/456,165, filed Dec. 22, 1989, for: WEFT THREAD MONITOR WITH CONTROL CIRCUIT TO ELIMINATE FALSE WEFT DEFECT SIGNALS, Art Unit: 247; Examiner: A. Falik, now U.S. Pat. No. 5,031,669, issue date: Jul. 16, 1991.

FIELD OF THE INVENTION

The invention relates to a method for controlling the weft thread insertion in an air jet loom. In air jet looms the weft thread is inserted by a main nozzle and transported through the insertion channel by relay or auxiliary nozzles. A starting signal provided by an electronic control causes the introduction of a gaseous medium from a first pressure source into the main nozzle for producing the weft thread insertion jet.

BACKGROUND INFORMATION

European Patent Publication EP 0,105,561 discloses a method for transporting a weft thread through the loom shed of a shuttleless loom by means of a weft thread insertion system having a number of insertion nozzles supplied with a fluid for transporting the weft thread. The speed of the weft thread is being measured as the weft thread travels through the insertion channel. A speed signal representing the weft thread speed is produced and transformed into a control signal for controlling an open loop system for influencing the components of the weft thread insertion system which produce the weft thread insertion speed. First, the speed of each weft thread is measured in the starting phase of the weft insertion cycle. The so received control signal is then processed so that either an auxiliary power source is switched into the weft thread insertion system at an earlier or a later point of time, or that the main power source of the weft thread insertion system is switched off, either earlier or later. The control is such, that the respective weft thread, after it has been released for insertion, passes through the weft thread inserting trajectory within a predetermined time counted from the weft thread release. The just mentioned inserting trajectory is measured between the exit of the main nozzle and the exit of the loom shed.

European Patent Publication EP 0,105,561 also discloses that an auxiliary power source is provided in the form of a second fluid source under pressure, whereby the pressure of the second fluid source is higher than the pressure of the main power source.

It is a disadvantage of the apparatus disclosed in European Patent Publication EP 0,105,561 that the measuring of the speed of the weft thread in the starting phase of the weft thread insertion cycle requires a speed detector that must be positioned within the weaving width near the weft thread insertion system. Such a position has an adverse influence on the appearance of the fabric because it causes an interruption in the fabric appearance. Such an interruption is generally not acceptable.

European Patent Publication EP 0,105,561 is based on the assumption that the insertion time will deviate from a rated insertion time value if the acceleration values of the weft thread also deviate from a rated acceleration value. However, this assumption as presented in the just mentioned European Patent Publication is unfounded because the weft thread flying time is not necessarily dependent on the initial acceleration of the weft thread. Rather, there is a dependency or relationship between the weft thread flying time and the application of the transporting force to the weft thread through the entire length of the weft thread or rather of the weft thread insertion channel.

German Patent Publication (DE-OS) 3,002,862 discloses a weaving loom equipped with an apparatus for inserting the weft thread by means of a medium, whereby the weft thread is transported by a main nozzle and a plurality of auxiliary or relay nozzles until the leading end of the weft thread has reached a catch nozzle. At the moment when the weft thread appears at the catch nozzle, a pick-up or signal generator or transducer produces a signal which is supplied to a comparator. The comparator also receives a signal from a further signal generator or transducer which monitors the loom operational speed. The two signals are compared, whereby the signal representing the loom speed is a rated signal and the result of the comparing is used as an adjustment signal for a pressure controllable valve in a closed loop control. The valve in turn controls the pressure of a medium supplied by a pressure source to the main nozzle and to the auxiliary or relay nozzles.

It is a disadvantage of the apparatus and method disclosed in German Patent Publication (DE-OS) 3,002,862 that the pressure increase in the main nozzle, and thus the increased acceleration of the weft thread in its starting phase, damages the weft thread and can even cause weft thread breaking. An excessive pressure peak in the starting phase of the weft thread insertion has in any case an adverse influence on the running characteristic of the loom and on the quality of the woven fabric.

Another disadvantage of the teachings disclosed in German Patent Publication (DE-OS) 3,002,862 is seen in that a pressure increase in the main nozzle actually lengthens the duration of the blowing which in turn causes the weft thread to flutter at a point of time when the loom shed is being closed. Such a flutter results in a loose weave, because the weft threads are inserted without a sufficient stretching on the insertion side.

OBJECTS OF THE INVENTION

In view of the foregoing it is the aim of the invention to achieve the following objects singly or in combination:

to provide a method for the control of the weft thread insertion which compensates for differences in the weft thread insertion times of different weft thread insertion cycles which follow each other sequentially;

to make such compensations always with reference to the timing or operation of the main nozzle as a starting point of time and with reference to the weft exit from the insertion channel;

to achieve the foregoing objects without any change in other parameters of the main acceleration phase within any particular weft thread insertion; and to provide an apparatus for performing the present method.

SUMMARY OF THE INVENTION

The weft thread insertion control according to the invention is characterized in that the entire weft thread insertion duration is divided into a first acceleration phase during which the weft thread is subject to a first acceleration caused by a fluid from a first pressure source having a first pressure $p_1$, and a second acceleration phase during which the weft thread is subject to a further acceleration at a second pressure $p_2$ provided by a second pressure source, whereby the point of time for the starting of the second weft thread acceleration, that is the starting of the second acceleration phase is controlled in response to a measured or actual weft thread insertion duration relative to a rated insertion duration. The acceleration of the weft thread in the first acceleration phase is selected with due regard to the type of the weft thread material for example, the insertion takes into account whether the weft thread is coarse, fine, smooth, or hairy. Factors representing such weft thread characteristics are entered into a memory of a central processing unit forming part of the control apparatus of the loom.

In order to determine the point of time ($t_3$) at which the second acceleration phase is started by switching-on of a second pressure source, the weft thread flying time or insertion duration of the individual weft thread being inserted, is measured over the weaving width, beginning with the point of time ($t_1$) when the weft thread is released at a pressure ($p_f$) of a gaseous medium from the first pressure source and ending at a point of time ($t_2$) when the weft thread arrives at the end of the weaving width. Normally, the point of time ($t_3$) will occur shortly after the end of the first acceleration phase of the weft thread.

The actual insertion time duration ($\Delta t$) between the points of time(t minus t ) is supplied to the electronic control where this actual time duration is compared in a comparator with a rated insertion time duration as a so-called rated-actual-value comparison. When there is a deviation from the rated value of the weft thread insertion time, the electronic control will cause a correction of the point of time ($t_3$) at which the second pressure source is switched-on. The correction may involve a shifting of the point of time ($t_3$) either ahead or back so that the switching on of the second pressure source takes place a little earlier or a little later, in other words, the point of time ($t_3$) at which the second pressure source is switched on, is variable. A correction of the switching-on time ($t_3$) of the second pressure source having a pressure ($p_2$) higher first pressure ($p_1$) of the first pressure source, causes a stabilization during the next following weft thread insertion, or rather for the next following weft thread insertions. Stated differently, the actual flying or insertion time of the weft thread will correspond with the rated flying time, whereby the difference between the rated and actual insertion durations will tend toward zero. As a result, the invention achieves a weft thread insertion which is free of faults in the sense of achieving a superior quality fabric free of faults. Weft thread flutter is avoided.

It is of special importance for the correction of the point of time when the second pressure source is switched-on at ($t_3$) that the starting conditions for the respective weft thread insertion are not influenced at all. The point of time ($t_1$) which signifies the start of the weft thread insertion at the pressure ($p_f$) when the weft thread is released is constant for each weft thread insertion cycle. However, the time ($\Delta t$) between ($t_1$) and ($t_2$) may vary for different types of weft threads having different air insertion characteristics as mentioned above.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
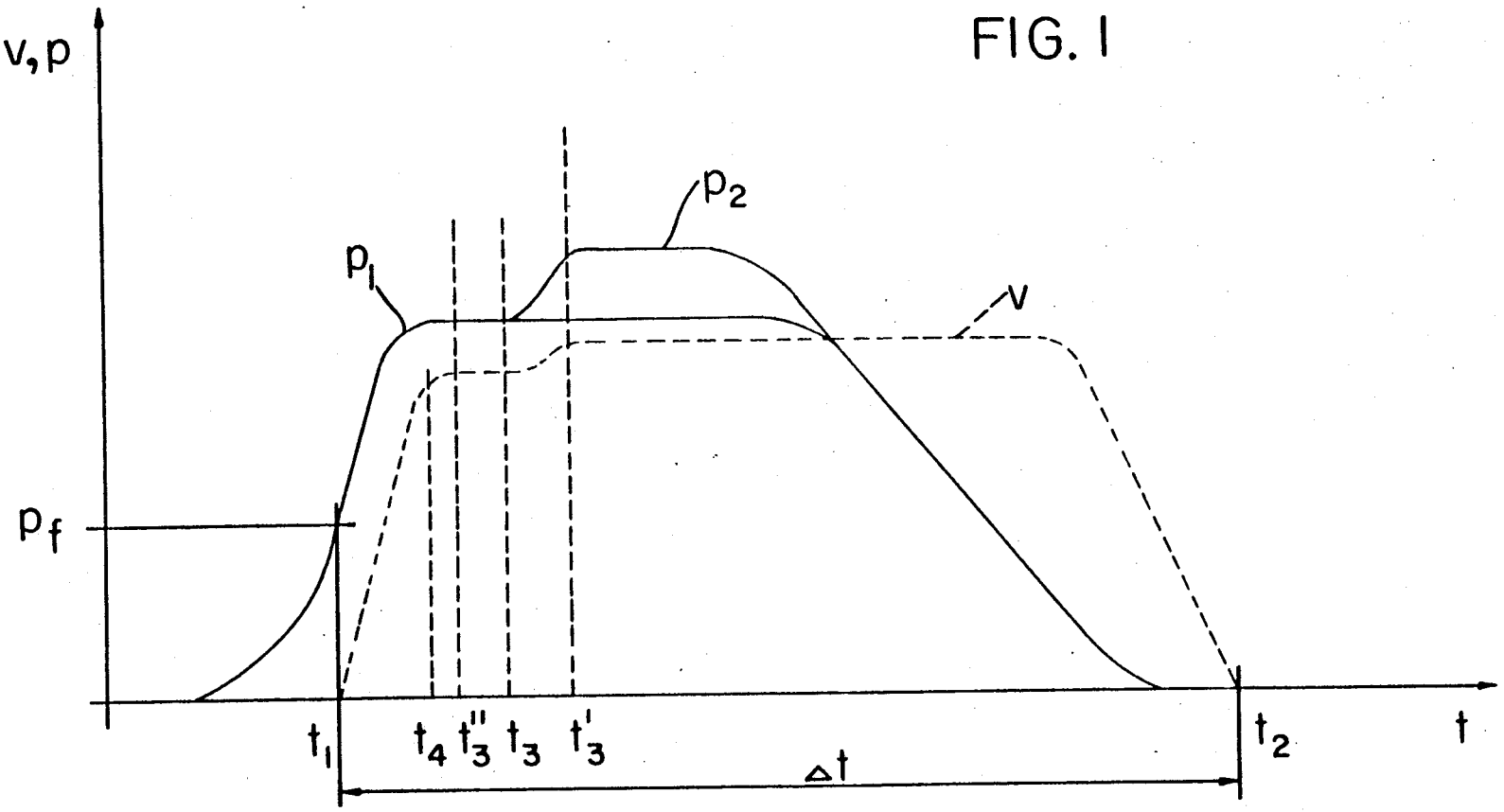
FIG. 1 is a timing diagram, whereby the ordinate indicates pressures and speeds with which the weft thread is being inserted, and wherein the abscissa indicates time.
Figure 2:
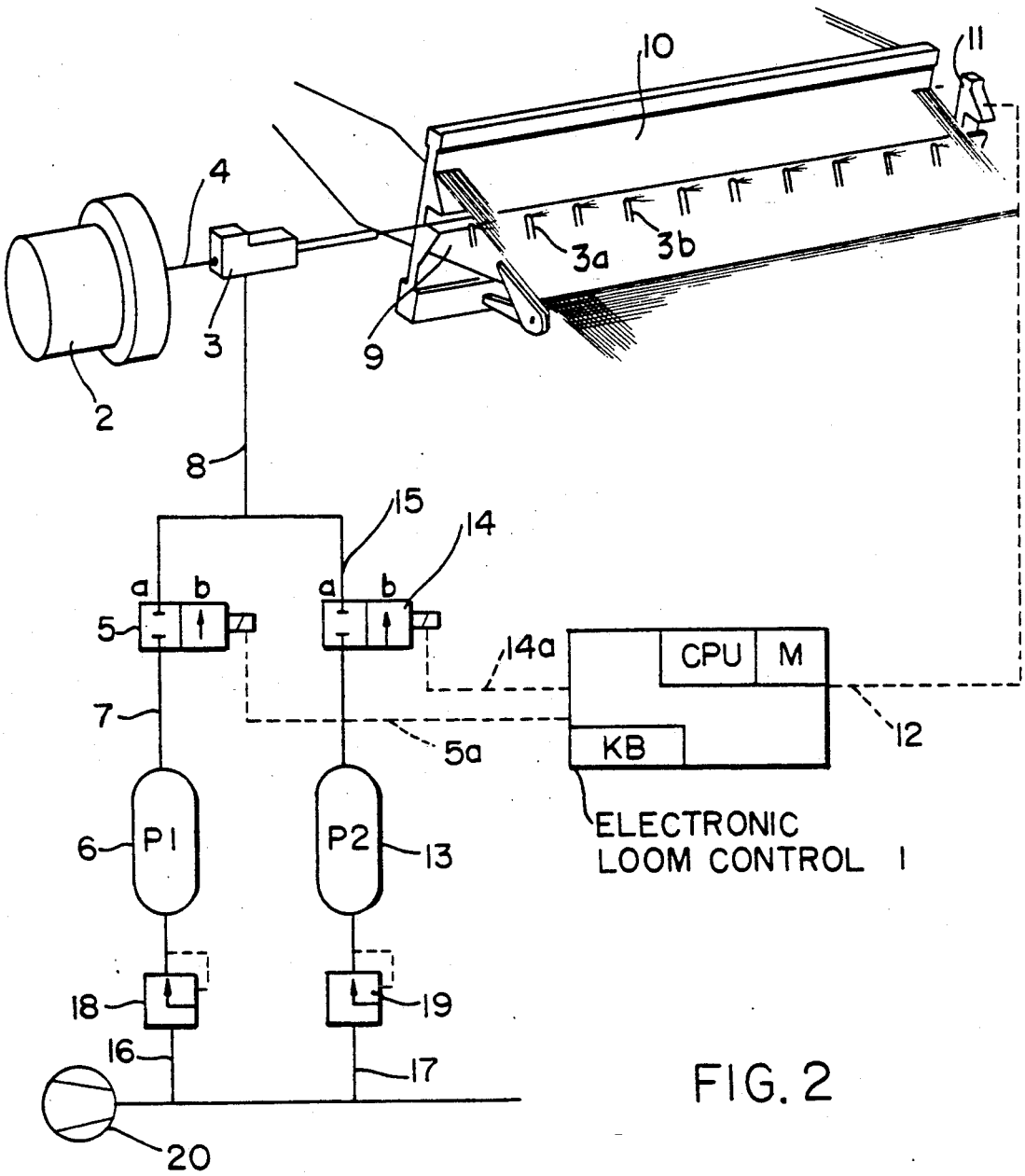
FIG. 2 illustrates a block diagram of an apparatus for performing the present method.

Referring to FIGS. 1 and 2, the following parameters are stored in a memory of an electronic loom control, shown in FIG. 2, prior to operating the loom. These parameters include the point of time $t_1$ when the weft thread is released for insertion, the rated point of time $t_2$ when the weft thread emerges from the shed, the rated weft thread insertion time R $\Delta t$ which is the time difference $t_2 - t_1$, the pressure $p_f$ required at the time of the weft thread release, and the pressure $p_l$ representing the pressure required for transporting the weft thread during an initial insertion phase. Additionally, weft thread specific values are also entered into the memory of the central loom control. Such weft thread specific values represent air effective yarn characteristics which depend on the type of weft thread material, for example, coarse weft threads, fine weft threads, smooth weft threads, or hairy weft threads. The exit time $t_2$ may vary, depending on these characteristics.

In FIG. 1 the weft thread is released for insertion into the loom shed at the point of time $_1$, whereby the applied pressure is delivered by a respective pressure source to reach the pressure value $p_f$ at the point of time $t_1$. This starting pressure $p_f$ is then increased to the pressure $p_l$ for accelerating the weft thread by the flow from the main nozzle in such a way that the weft thread will have a nearly or approximately constant insertion speed v. Stated differently, the insertion speed will be such that the thread will require an actual insertion time $\Delta t$ corresponding to the rated insertion time R$\Delta t$. A weft thread monitor shown in FIG. 2 is arranged at the exit end of the weft thread insertion channel for sensing an actual exit point of time by generating an electric pulse signal that signifies the arrival of the weft thread at the exit of the weft thread insertion channel. The duration between $t_1$ and $t_2$ is measured by a pulse count starting at t, and ending at $t_2$ as is conventional.

When the measured time, that is the actual weft thread insertion time, deviates from the stored rated insertion time R$\Delta t$, a correction will be made as a result of the respective difference signal. The correction will depend on whether the actual weft thread insertion time was longer or shorter than the rated insertion time.

If the actual insertion time is longer than the rated insertion time R$\Delta t$, the next following weft thread insertion cycle will be corrected so that following the first acceleration phase the application of the second acceleration phase will start earlier. The second acceleration phase normally begins or start at the point of time $t_3$. For beginning the second acceleration phase earlier the point $t_3$ will be shifted to the left on the abscissa to point $t''_3$. This shift of the point $t_3$ to the left results in the application of the second acceleration by means of the main nozzle at an earlier time in order to assure the rated insertion time $R\Delta t$. In other words, the earlier application of the second acceleration shortens the overall insertion time.

If the weft thread travels too fast and arrives at the exit of the insertion channel at a time prior to the time determined by $R\Delta t$, the correction is made so that the second acceleration is applied at a point of time $t'_3$ that occurs later than the normal time $t_3$ for the application of the second acceleration. This is shown by the dashed line curve in FIG. 1.

FIG. 1 also shows a point of time $t_4$ representing the earliest possible time when the second acceleration is applied to the weft thread by increasing the pressure through the main nozzle. At the time $t_4$ the weft thread has achieved its insertion speed. If the point of time $t_4$ takes place any earlier, namely when the pressure $p_1$ of the first pressure source is still effective in the main nozzle, the additional switch-on of the second pressure source delivering the second pressure $p_2$ generally damages the weft thread which results in a diminished quality of the finished fabric. Thus, $t_4$ can be located at the earliest when the first acceleration phase is completed by switching off the pressure $p_1$.

The main advantage of the invention is seen in that the exact acceleration needed for any particular yarn characteristic values can now be applied to the weft thread. This is important, especially in connection with the weaving of very fine yarns which cannot stand an excess stress during the starting phase of the weft thread insertion. Simply reducing the pressure applied during the starting phase is not satisfactory because it will accelerate the weft thread to an insufficient extent. As a result, the weft thread will assume a wavy configuration as it passes through the weft thread insertion channel. Removing such waviness by stretching the weft thread for achieving the desired fabric quality is virtually impossible. The invention has avoided this problem because it has been found that applying a second acceleration to the weft thread at a proper point of time following the first acceleration will avoid the mentioned waviness, thereby assuring a high quality fabric.

FIG. 2 shows an apparatus for performing the present method. An electronic loom control 1 including a central processing unit CPU with a memory M and a keyboard KB operates on the basis of parameters entered into the memory prior to starting the loom operation. Such parameters are entered, for example, into the memory through the keyboard and include the above mentioned point of time $t_1$ when the weft thread 4 is released from a thread supply 2 into the main nozzle 3. The parameters include the rated time $t_2$ when the weft thread is supposed to exit from the weft thread insertion channel formed in the reed 10. The actual exit point of time is sensed by a sensor 11 connected to an input of the electronic loom control through a conductor 12. When the thread passes the sensor 11 a count stop pulse is generated. The above parameters further include the rated time $R\Delta t = t_2 - t_1$ defined above. Further, the pressure $p_f$ applied at the time of the weft thread release, is also entered into the memory of the central processing unit. Similarly, the required pressure $p_1$ is entered as a rated value for the pressure required during the eft thread insertion through the entire channel.

When the loom drive has been started, a control valve 5 magnetically controlled by the loom control 1 as indicated at 5*a* is switched open at the point of time $t_1$, which also starts a pulse count whereby the first pressure source 6 is connected through the pressure conduits 7 and 8 to the main nozzle 3 for supplying a transport fluid to the main nozzle 3 to move the weft thread 4 into and through the loom shed 9, or rather through the channel formed by the reed 10. Auxiliary nozzles 3*a*, 3*b* are arranged along the insertion channel as is conventional. The weft thread 4 is accelerated by the pressure $p_1$ to such an acceleration that it normally can pass through the loom shed 9 within the rated passage time $R\Delta t$. The actual exit point of weft thread sensor 11 ascertains the time at the end of the reed 10. As mentioned, the output of the weft thread sensor or monitor 11 is supplied to the loom control 1 through conductor 12 as a pulse count stop signal.

The central processing unit performs a comparing of the rated value with the actually measured value. If a deviation of the measured transition time from the rated time is ascertained, in the sense that more time was needed for the weft thread insertion, than is indicated by the rated time, the next following weft thread insertion is corrected in such a way that the second acceleration phase following the first acceleration phase as controlled by the loom control, starts earlier. In other words, the second pressure source 13 is switched on earlier than would normally be the case. The second pressure source 13 is connected to the main nozzle through a control valve 14 and through pressure conduits 15, 8. The valve 14 is controlled by the control 1 magnetically through a conductor 14*a*. By opening the control valve 14 a little earlier, the second acceleration will compensate for any delayed arrivals that have been measured for the preceding weft thread insertion. Similarly, when the weft thread arrives too early, the correction will be made to start the second acceleration phase a little later as described above with reference to FIG. 1.

The first pressure source 6 for the pressure $p_1$ and the second pressure source 13 for the pressure $p_2$ are connected through pressure conduits 16 and 17 and through pressure limiting valves 18 and 19 to a common pressure source 20.

Although the invention has been described with reference to specific example embodiments it will be appreciated that it is intended to cover all modifications and equivalents within the scope of the appended claims.

What I claim is:

1. A method for controlling the weft thread insertion into and through a weft thread insertion channel in an air jet loom during a weft thread insertion duration, comprising the following steps:

(a) dividing said weft thread insertion duration into a first acceleration phase and into a second acceleration phase following said first acceleration phase in time, (b) applying a first acceleration through a main nozzle to said weft thread during said first weft thread acceleration phase, (c) applying a second acceleration to said weft thread during said second weft thread acceleration phase, (d) producing a control signal for starting said second acceleration phase, as a function of a difference between a rated weft thread insertion duration and an actual weft thread insertion duration, and (e) controlling a starting time ($t_3$) of said second acceleration phase in response to said control signal in such a way that said difference tends toward zero.

2. The method of claim 1, further comprising modifying said first acceleration in response to yarn specific characteristics of said weft thread.

3. The method of claim 1, further comprising performing said first acceleration at a first pressure ($p_1$) of a pressure medium passing through said main nozzle, and performing said second acceleration at a second pressure ($p_2$).

4. The method of claim 3, wherein said second pressure ($p_2$) is maintained to be higher than said first pressure ($p_1$).

5. The method of claim 3, wherein said starting time ($t_3$) of said second acceleration phase for an application of said second pressure ($p_2$), is variable.

6. The method of claim 3, wherein said second pressure ($p_2$) is maintained temporarily during a duration of a complete weft thread insertion.

7. The method of claim 1, further comprising maintaining starting conditions constant for all weft thread insertion cycles of a weaving sequence.

8. The method of claim 1, wherein said second weft thread acceleration is also applied through said main nozzle.

9. A method for controlling the weft thread insertion into and through a weft thread insertion channel in an air jet loom, comprising the following steps:

(a) entering into a memory of a central electronic loom control, weft thread specific values and insertion values including rated pressure values for a fluid used as tee insertion medium and rated timing values for a rated insertion time, (b) measuring actual weft thread insertion times to produce respective actual time values representing the actual weft thread insertion duration, (c) comparing a rated timing value with an actual insertion time value to provide a respective difference value which indicates whether an actual insertion takes more or less time than the respective rated insertion time and producing respective first and second timing control signals for controlling the weft thread insertion, (d) applying a first pressurized jet through a main nozzle to said weft thread in response to a first nozzle jet control signal for accelerating said weft thread during a first weft thread acceleration phase, (e) applying a second pressurized jet through said main nozzle to said weft thread in response to a second nozzle jet control signal for accelerating said weft thread during a second weft thread acceleration phase, and (f) controlling the start of said second acceleration phase in response to one of said first and second timing control signals for reducing said difference value substantially to zero.

10. The method of claim 9, wherein a first pressure ($p_1$) is applied during said first weft thread acceleration phase, and a second pressure ($p_2$) is applied during at least part of said second weft thread acceleration phase, and wherein said second pressure ($p_2$) is higher than said first pressure ($p_1$) at least during part of said second weft thread acceleration phase.

11. The method of claim 9, wherein said start of said second acceleration phase is caused to start earlier in response to said one timing control signal signifying a late arrival of said weft thread at an exit of said weft thread insertion channel, and wherein said start of said second acceleration phase is delayed in response to said one timing control signal signifying an early arrival of said weft thread at said exit, whereby said late arrival and said early arrival is determined relative to said rated timing value.

* * * * *